US012281469B2

(12) United States Patent
Malczyk et al.

(10) Patent No.: US 12,281,469 B2
(45) Date of Patent: Apr. 22, 2025

(54) CROSS-LAMINATED TIMBER AND COLD-FORMED STEEL CONNECTOR AND SYSTEM

(71) Applicant: Mercer Spokane LLC, Spokane Valley, WA (US)

(72) Inventors: Robert Malczyk, Vancouver (CA); Hercend Mpidi Bita, Vancouver (CA); Ricardo Jose Delgado Sousa Brites, Vancouver (CA)

(73) Assignee: Mercer Spokane LLC, Spokane, WA (US)

( * ) Notice: Subject to any disclaimer, the term of this patent is extended or adjusted under 35 U.S.C. 154(b) by 0 days.

(21) Appl. No.: 18/645,114

(22) Filed: Apr. 24, 2024

(65) Prior Publication Data

US 2024/0279919 A1 Aug. 22, 2024

Related U.S. Application Data

(63) Continuation of application No. 17/187,362, filed on Feb. 26, 2021, now abandoned.

(51) Int. Cl.

| | |
|---|---|
| ***E04B 1/38*** | (2006.01) |
| ***E04B 2/58*** | (2006.01) |
| ***E04B 5/02*** | (2006.01) |
| ***E04C 2/12*** | (2006.01) |

(52) U.S. Cl.

CPC ..... *E04B 1/388* (2023.08); *E04B 2/58* (2013.01); *E04B 5/02* (2013.01); *E04C 2/12* (2013.01)

(58) Field of Classification Search

CPC . E04B 1/24; E04B 1/2403; E04B 1/40; E04B 2/58; E04B 5/02; E04B 1/0038; E04B 1/2604; E04B 2001/2484; E04C 2/12

USPC ..... 52/236.6

See application file for complete search history.

(56) References Cited

U.S. PATENT DOCUMENTS

| | | | |
|---|---|---|---|
| 1,374,054 | A | 4/1921 | Bridge |
| 2,184,252 | A | 12/1939 | Garrett et al. |
| 4,019,291 | A | 4/1977 | Ernst |
| 4,103,725 | A | 8/1978 | Abe |
| 4,130,970 | A | 12/1978 | Cable |
| 4,302,136 | A | 11/1981 | Abe et al. |

(Continued)

FOREIGN PATENT DOCUMENTS

| | | |
|---|---|---|
| CA | 3211705 | 9/2022 |
| WO | 2022183088 A1 | 9/2022 |
| WO | 2022183089 A1 | 9/2022 |

OTHER PUBLICATIONS

Advisory Action for U.S. Appl. No. 17/187,362, mailed Nov. 21, 2023, 3 pages.

(Continued)

*Primary Examiner* — James J Buckle, Jr.

(74) *Attorney, Agent, or Firm* — Elliott, Ostrander & Preston, P.C.

(57) ABSTRACT

A cross-laminated timber (CLT) and cold formed steel (CFS) connector and system is provided. The CLT and CFS connector comprises a track, at least one fastener, and at least one spring. The track is configured to connect to at least one CFS stud. The at least one fastener includes a head and shaft. The at least one fastener is configured to connect the track to a CLT panel. The at least one spring is configured to receive the shaft of the fastener and compress between the head of the fastener and the track. Methods of installing the CLT and CFS connector and system are also provided.

20 Claims, 13 Drawing Sheets

(56) References Cited

U.S. PATENT DOCUMENTS

| | | | |
|---|---|---|---|
| D283,591 | S | 4/1986 | Swanstrom |
| 4,633,634 | A | 1/1987 | Nemmer et al. |
| 4,672,785 | A | 6/1987 | Salvo |
| 4,716,695 | A | 1/1988 | Alexander et al. |
| 4,720,223 | A | 1/1988 | Neights et al. |
| 4,959,064 | A | 9/1990 | Engelhardt |
| 5,113,631 | A | 5/1992 | diGirolamo et al. |
| 5,195,293 | A | 3/1993 | diGirolamo et al. |
| 5,353,560 | A | 10/1994 | Heydon |
| 5,620,290 | A | 4/1997 | Homfeldt et al. |
| 5,669,194 | A | 9/1997 | Colasanto et al. |
| 5,689,922 | A | 11/1997 | Daudet |
| D391,844 | S | 3/1998 | Ropponen et al. |
| D392,179 | S | 3/1998 | Ropponen et al. |
| 6,644,903 | B1 | 11/2003 | Arand |
| 6,925,772 | B1 | 8/2005 | Iwakawa |
| 7,509,778 | B2 | 3/2009 | Leek |
| 7,665,257 | B2 | 2/2010 | Posey |
| 7,856,786 | B2 | 12/2010 | Beck et al. |
| D656,392 | S | 3/2012 | McKenna |
| 8,505,253 | B1 | 8/2013 | Medford |
| 8,585,336 | B2 | 11/2013 | Tao et al. |
| 8,650,825 | B2 | 2/2014 | Minamikawa |
| D729,052 | S | 5/2015 | Summers et al. |
| 9,435,368 | B2 | 9/2016 | Stewart |
| 9,530,525 | B2 | 12/2016 | DeSantis et al. |
| D777,015 | S | 1/2017 | Deveci |
| D846,455 | S | 4/2019 | Wichern |
| D861,465 | S | 10/2019 | Haider |
| 10,550,570 | B2 | 2/2020 | Burt et al. |
| 10,711,477 | B1 | 7/2020 | Anderson et al. |
| 10,745,904 | B2 | 8/2020 | Ernst |
| 10,767,725 | B2 | 9/2020 | Amruthnath |
| 10,961,739 | B2 | 3/2021 | Lee |
| 11,028,580 | B2 | 6/2021 | Burt et al. |
| 11,105,085 | B2 | 8/2021 | Hensen et al. |
| D950,368 | S | 5/2022 | Wang |
| 2003/0175091 | A1 | 9/2003 | Aukzemas et al. |
| 2004/0216398 | A1 | 11/2004 | Manos et al. |
| 2019/0048574 | A1 | 2/2019 | Ernst |
| 2019/0168410 | A1 | 6/2019 | Conboy |
| 2019/0186121 | A1 | 6/2019 | Maderebner et al. |
| 2020/0048906 | A1 | 2/2020 | Honkala |
| 2020/0299962 | A1 | 9/2020 | Espinosa |
| 2021/0295813 | A1 | 9/2021 | Gernhart et al. |
| 2022/0275635 | A1 | 9/2022 | Malczyk et al. |

OTHER PUBLICATIONS

Final Office Action for U.S. Appl. No. 17/187,362, mailed Aug. 8, 2023, 11 pages.

International Search Report and Written Opinion for International Patent Application No. PCT/US22/18056, mailed May 20, 2022, 6 pages.

International Search Report and Written Opinion for International Patent Application No. PCT/US22/18057, mailed Apr. 6, 2022, 6 pages.

Non-Final Office Action for U.S. Appl. No. 17/187,362, mailed Oct. 28, 2021, 10 pages.

Non-Final Office Action for U.S. Appl. No. 17/187,362, mailed Jul. 28, 2022, 10 pages.

Non-Final Office Action for U.S. Appl. No. 17/187,380, mailed Oct. 28, 2021, 12 pages.

Non-Final Office Action for U.S. Appl. No. 17/187,380, mailed Aug. 19, 2022, 8 pages.

Notice of Allowance for U.S. Appl. No. 17/187,362, mailed Jan. 24, 2024, 8 pages.

CROSS-LAMINATED TIMBER AND COLD-FORMED STEEL CONNECTOR AND SYSTEM

CROSS-REFERENCE TO RELATED APPLICATIONS

This application is a continuation of U.S. patent application Ser. No. 17/187,362, filed on Feb. 26, 2021, the entire contents of which are hereby incorporated by reference herein.

FIELD OF INVENTION

The present invention relates generally to the art of building construction, and more specifically to a connector that connects cold formed steel and cross-laminated timber.

BACKGROUND

A cross-laminated timber (CLT) commercial building may typically be a post and beam configuration. The posts are either glulam or steel-reinforced concrete and the beams are also glulam or reinforced concrete. The floor slabs of the building are CLT. A building comprising cross-laminated timber (CLT) panels such as CLT floors require a large steel panel under the CLT panel to connect the CLT panel to cold formed steel (CFS) studs and to support the load from the CFS studs. The CFS panels connecting the CLT floor to the CFS studs are heavy, costly, and labor intensive. Concrete building are heavy requiring a bigger foundations and more robust lateral systems. Concrete buildings also require re-shoring under active floors and a large labor crew size. Concrete decks are fabricated on site leading to a multiple step installation process.

SUMMARY

A cross-laminated timber (CLT) and cold formed steel (CFS) connector is provided. The CLT and CFS connector comprises a track, at least one fastener, and at least one spring. The track is configured to connect to at least one CFS stud. The at least one fastener includes a head and a shaft. The at least one fastener is configured to connect the track to a CLT panel. The at least one spring is configured to receive the shaft of the fastener and compress between the head of the fastener and the track. The CLT and CFS connector may also include a second track and at least one second fastener. The second track is configured to connect to at least on second CFS stud. The at least one second fastener is configured to connect the second track to a second side of the CLT panel. A method of installing the CLT and CFS connector is also provided.

A CLT and CFS system is provided. The CLT and CFS system comprises a CLT panel, at least one CFS stud, a track, at least one fastener and at least one spring. The track is configured to connect to the at least one CFS stud. The at least one fastener includes a head and a shaft. The at least one fastener is configured to connect the track to the CLT panel. The at least one spring is configured to receive the shaft of the at least one fastener and compress between the head of the at least one fastener and the track. The CLT and CFS system may also include a second track and at least one second fastener. The second track is configured to connect to the at least one second CFS stud. The at least one second fastener is configured to connect the second track to a second side of the cross-laminated timber panel. A method of installing the CLT and CFS system is also provided.

BRIEF DESCRIPTION OF THE DRAWINGS

The foregoing summary, as well as the following detailed description will be better understood when read in conjunction with the appended drawings. For the purpose of illustration, there is shown in the drawings different embodiments. It should be understood, however, that the teachings are not limited to the precise CLT and CFS connector, system, and methods of installation shown.

DETAILED DESCRIPTION

A cross-laminated timber (CLT) and cold formed steel (CFS) connector and a CLT and CFS system are provided. The CLT and CFS connector provides a mechanism to connect CLT panels to CFS studs to construct a structure such as a building. For example, the CLT and CFS connector connects CFS studs of walls of a building to a CLT panel floor. The CLT and CFS connector provides a structural solution that addresses the shrinkage and compressive and bearing forces on CLT platform floors. The CLT and CFS connector also provides a structural solution for in-plan or horizontal movements of the CLT panel with respect to the CFS studs. The CLT and CFS connector and system allows lighter building structures and are conducive for evolving structural code changes. The CLT floor panels do not require reshoring. Installing CLT and CFS systems also requires smaller crew sizes than concrete structures. Off-site fabrication of the CLT and CFS connectors and CLT panels allows for a single-step installation on-site saving time and/or money.

Figure 1:
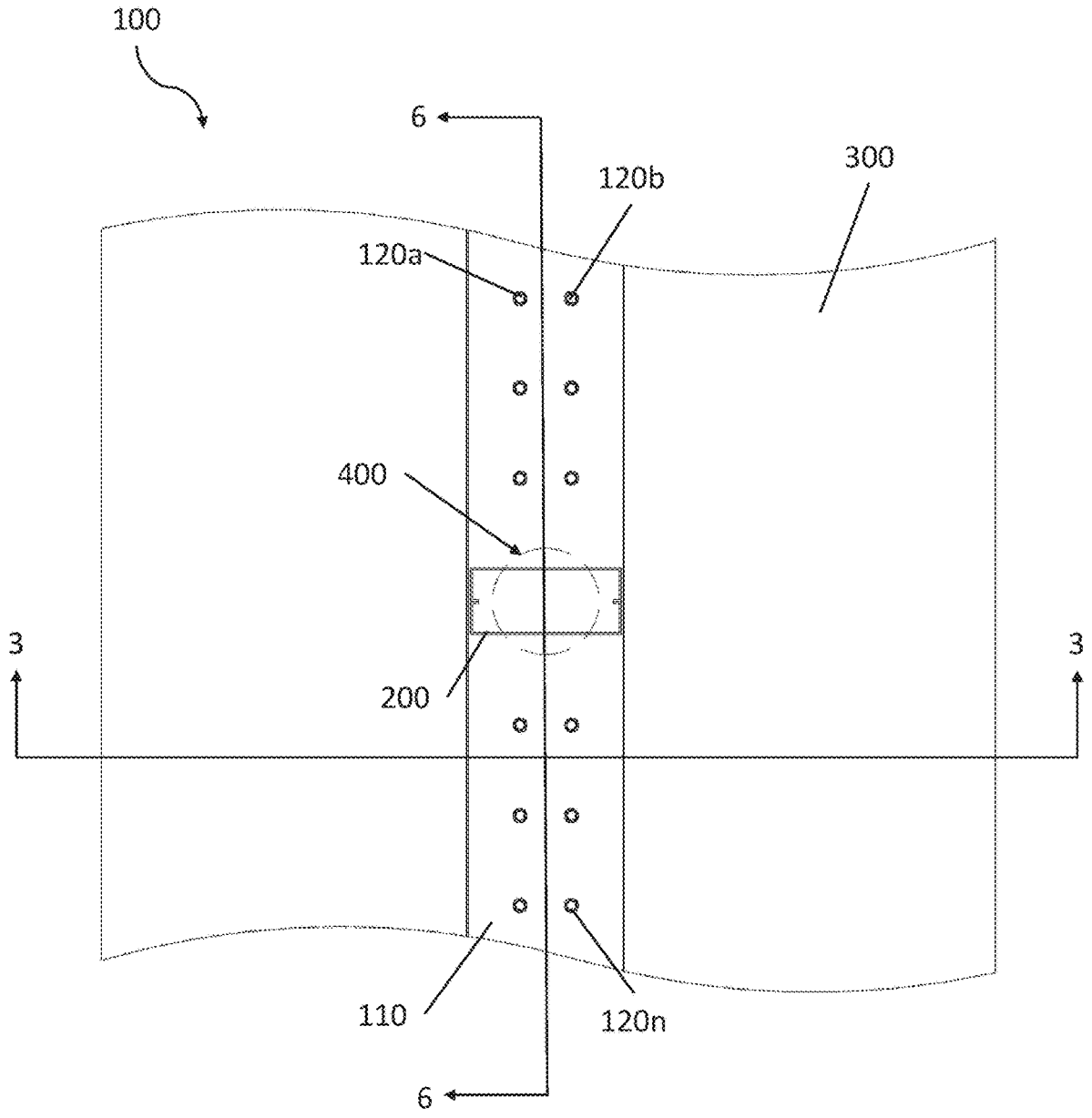
FIG. 1 shows a top view of a CLT and CFS connection with a precast concrete or wooden spacer.

FIG. 1 shows a top view of a CLT and CFS connection 100 with a precast concrete or wooden spacer 400. The CLT and CFS connection 100 includes a track 110 that is configured to connect to a CFS stud 200 and a CLT panel 300. The track 110 may be made from CFS. The track 110 is connected to the CLT panel 300 with at least one spring assembly 120*a-n*. Each spring assembly 120*a-n* includes a fastener and spring (shown in FIG. 2). The CLT and CFS connection 100 may include a spacer 400. The spacer 400 may be comprised of precast concrete, steel, or wood. The spacer 400 is nested within the CLT panel 300 at the approximate location of the CFS stud 200. The spacer 400 is located under a CFS stud or between CFS studs within construction and engineering tolerances.

Figure 2:
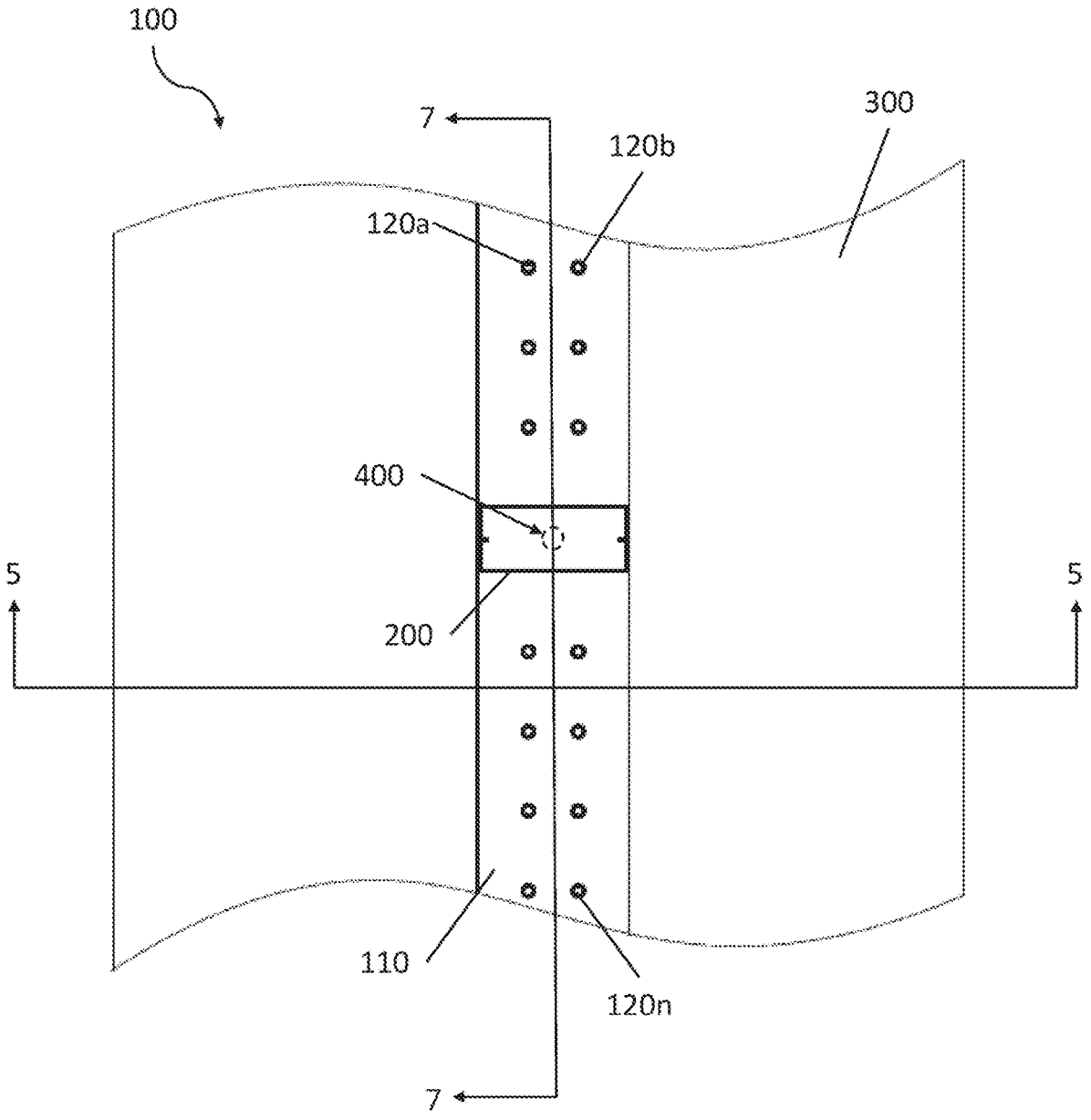
FIG. 2 shows a top view of a CLT and CFS connection with a steel spacer.

FIG. 2 shows a top view of a CLT and CFS connection 100 with a steel spacer 400. The CLT and CFS connection 100 has the same details and embodiments as the CLT and CFS connection 100 of FIG. 1 except the spacer 400 is made of steel instead of precast concrete or wood. As shown in FIG. 2, the steel spacer 400 may have a smaller cross-area than the precast concrete or wood spacer 400.

Figure 3:
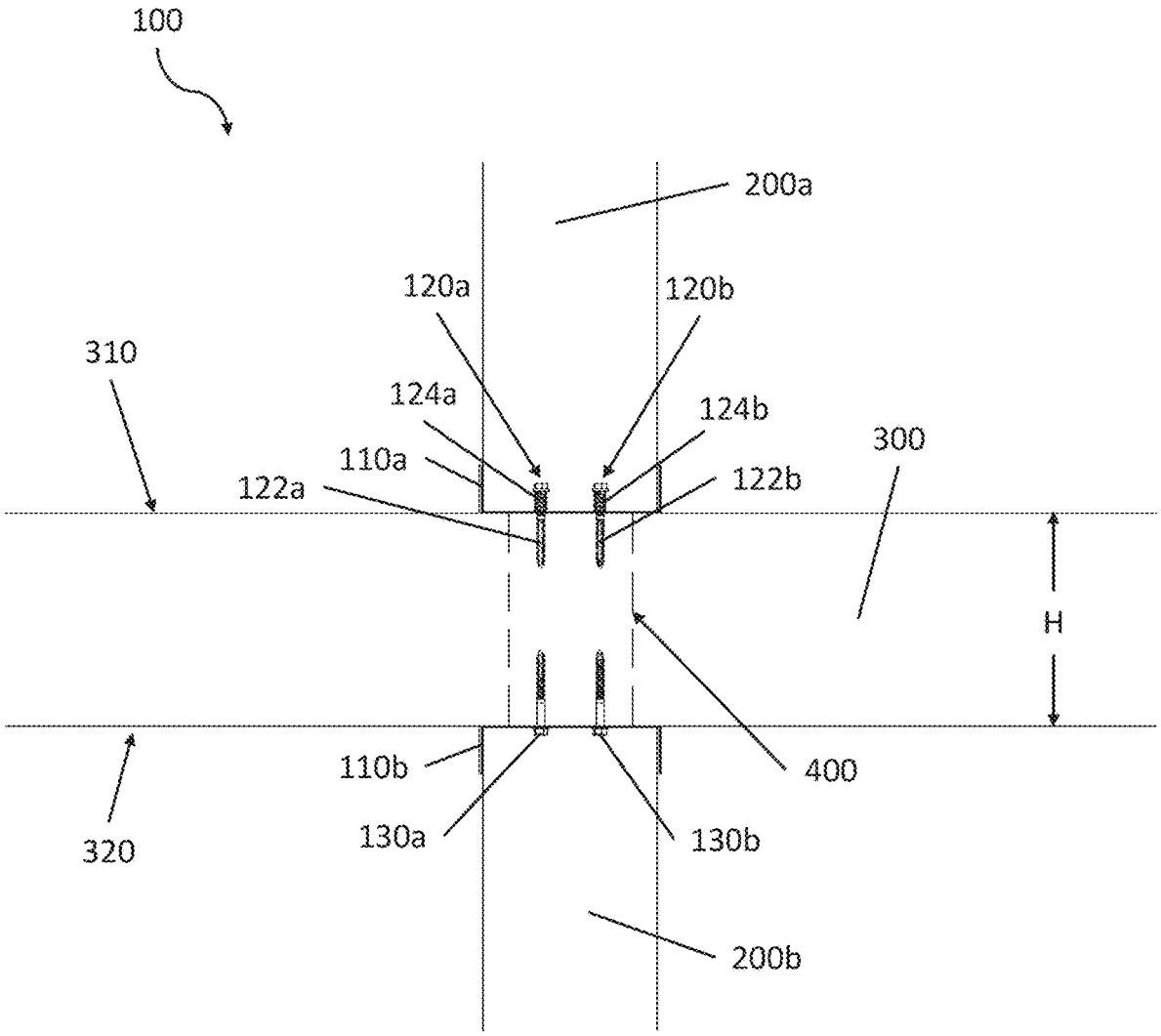
FIG. 3 shows cross-section 3-3 from FIG. 1.

FIG. 3 shows the cross-section 3-3 from FIG. 1. The CLT and CFS system 100 may include a first track 110*a* and a second track 110*b*. The CLT and CFS system 100 may include a first CFS stud 200*a* and a second CFS stud 200*b*. The first track 110*a* and the second track 110*b* may be made from CFS. The tracks 110*a*, 110*b* may be U-shaped or C-shaped. The tracks 110*a*, 110*b* may include a first flange and a second flange that may be approximately 2 inches in length. The first track 110*a* is configured to connect to the first CFS stud 200*a* and the second track 110*b* is configured to connect to the second CFS stud 200*b*. The first CFS stud 200*a* and second CFS stud 200*b* may fit snuggly between the first and second flange of the first track 110*a* and second track 110*b* respectively. At least one second fastener 130*a-n* connects the second track 110*b* to a second side 320 of the CLT panel 300. The CFS studs 200*a*, 200*b* may be connected to the tracks 110*a*, 110*b* via fasteners, welded seems, or friction fit.

Spring assemblies 120*a-n* connect the first track 100*a* to a first side 310 of the CLT panel 300. The spring assembly 120*a-n* includes a fastener 122*a-n* and a spring 124*a-n*. Each fastener 122*a-n* have a head and a shaft. The fastener 122*a-n* may be a screw. The spring 124*a-n* is configured to receive the shaft of the fastener 122*a-n*. The spring 124*a-n* is also configured to compress between the head of the fastener 122*a-n* and the track 110*a* when the spring assembly 120*a-n* is installed. The spring assembly 120*a-n* accounts for shrinkage and movements of the CLT panel 300 due to climate variations. For example, in cold and dry conditions, the height H of a CLT panel 300 may shrink. The height H may shrink approximately 0.25 inches. Because the spacer 400 is made from steel, precast contract, or wood, there is minimal to no shrinkage of the spacer 400. As the CLT panel 300 shrinks, a space is created between the bottom of the first track 110*a* and the top 310 of the CLT panel 300. When the CLT panel 300 shrinks, the end of the fastener 122*a-n* embedded in the CLT panel 300 gets pulled down. When the end of the fastener 122*a-n* embedded in the CLT panel 300 gets pulled down, the spring 124*a-n* compresses between the head of the fastener 122*a-n* and the top of the track 110*a*. The springs 124*a-n* may be installed in a partially compressed condition prior to shrinkage of the CLT panel 300 taking place. For example, the springs 124*a-n* may be compressed approximately 0.25 inches when the fastener 122*a-n* is installed. When the CLT panel 300 shrinks, the spring 124*a-n* will compress further. The spring assembly 120*a-n* connects the CFS stud 200*a* and the CLT panel 300 while accounting for movement, such as shrinkage or creep, of the CLT panel 300.

The spacer 400 is positioned within the CLT panel 300 and between the first CFS stud 200*a* and the second CFS stud 200*b*. The spacer 400 is positioned so that the first CFS stud 200*a* bears on the spacer 400 and load is transferred through the first CFS stud 200*a* to the second CFS stud 200*b*. The spacer 400 in FIG. 2 is a precast concrete or wooden cylinder.

Figure 4:
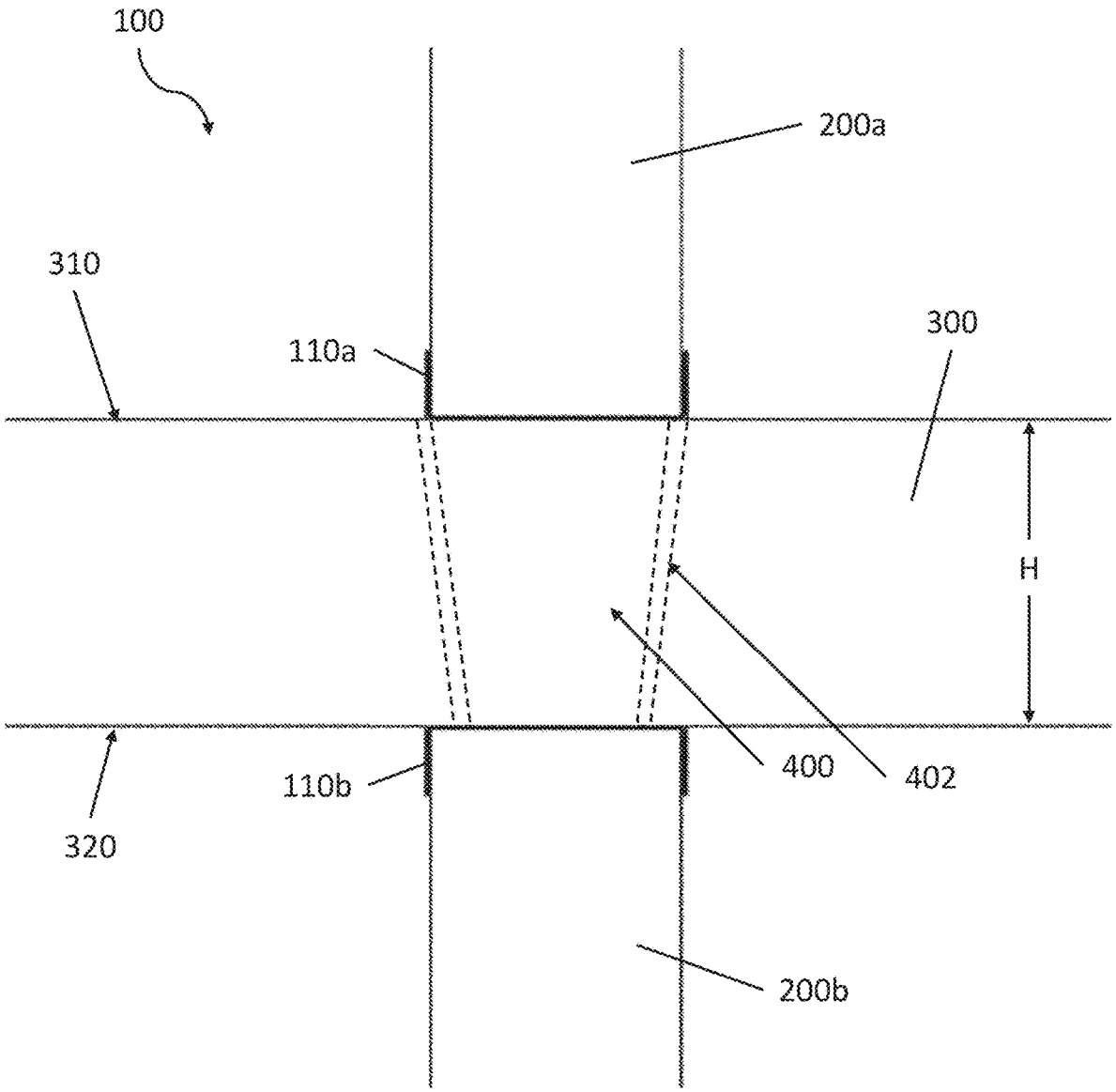
FIG. 4 shows an alternative embodiment of FIG. 3.

FIG. 4 shows an alternative embodiment of FIG. 3. The spring assemblies 120*a-n* and second fasteners 130*a-n* are not shown for clarity. The spacer 400 may be coned shaped so that the spacer 400 is wider at the top or end towards the top or first side 310 of the CLT panel 300. A spacer 400 that is wider at the top, as shown in FIG. 4, prevents the spacer 400 from falling out if the spacer 400 is installed prior to lifting the CLT panel 300 into place. The spacer 400 may also include a membrane or barrier 402. The membrane or barrier 402 may prevent bleeding of a precast concrete spacer 400 into the surrounding wood CLT panel 300.

Figure 5:
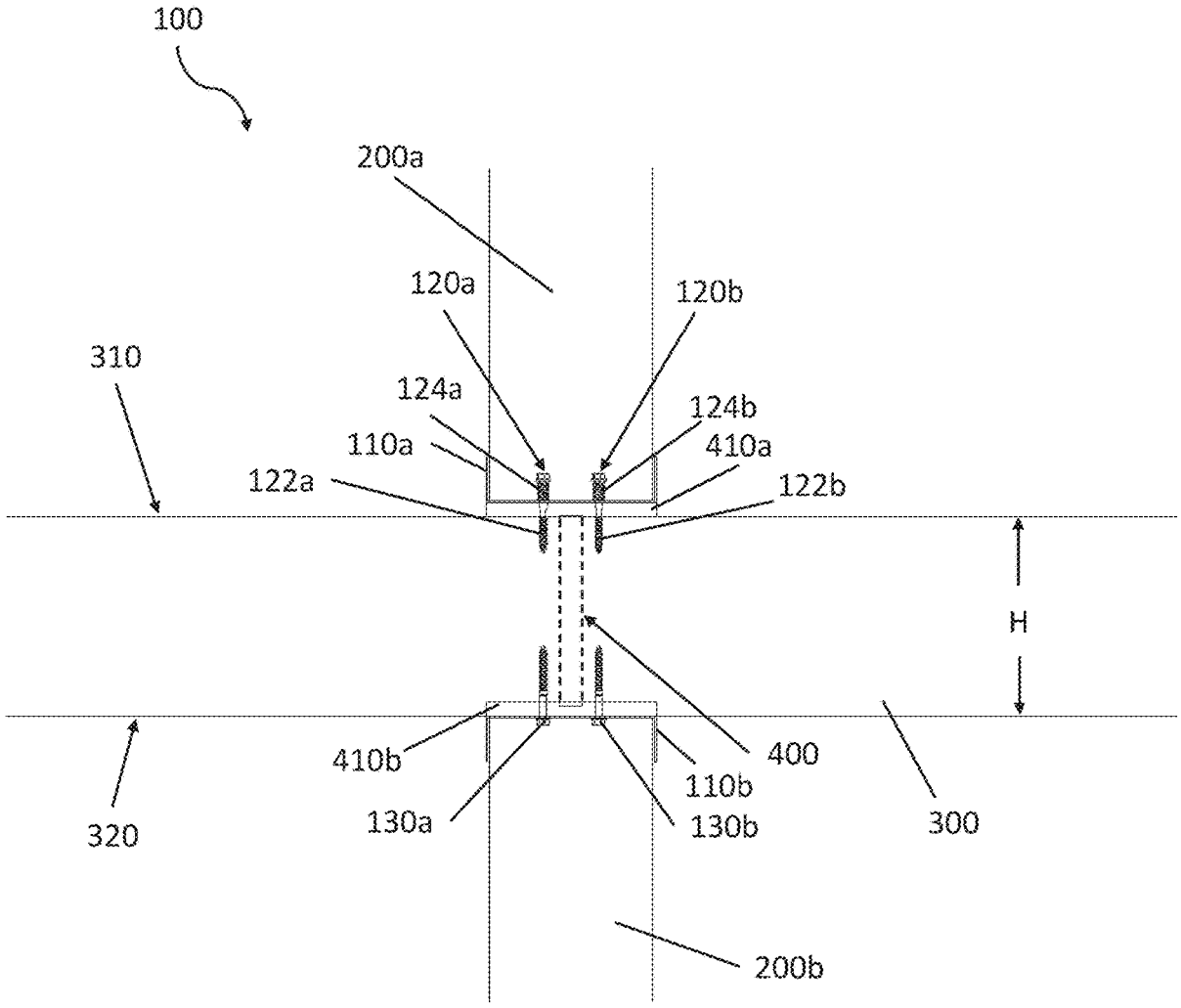
FIG. 5 shows cross-section 5-5 from FIG. 2.

FIG. 5 shows the cross-section 5-5 from FIG. 2. FIG. 4 shows a CLT and CFS system 100 with a spacer 400 made of steel. The CLT and CFS system 100 may also include steel plates 410*a*, 410*b* between the end of the spacer 400 and CLT panel 300 and the tracks 110*a*, 110*b*. The steel plates 410*a*, 410*b* may be connected to the tracks 110*a*, 110*b* with fasteners, welded seems, or a threaded end that may screw into a corresponding threaded hole in the track 110*a*, 110*b*. The steel spacer 400 is connected to the first steel plate 410*a*. The steel spacer 400 may be welded to the first steel plate 410*a*. The steel spacer 400 may include threads that screw into a corresponding threaded hole in the steel plate 410*a* or vice versa. The steel spacer 400 may have a bearing connection with the second steel plate 410*b*.

Figure 6:
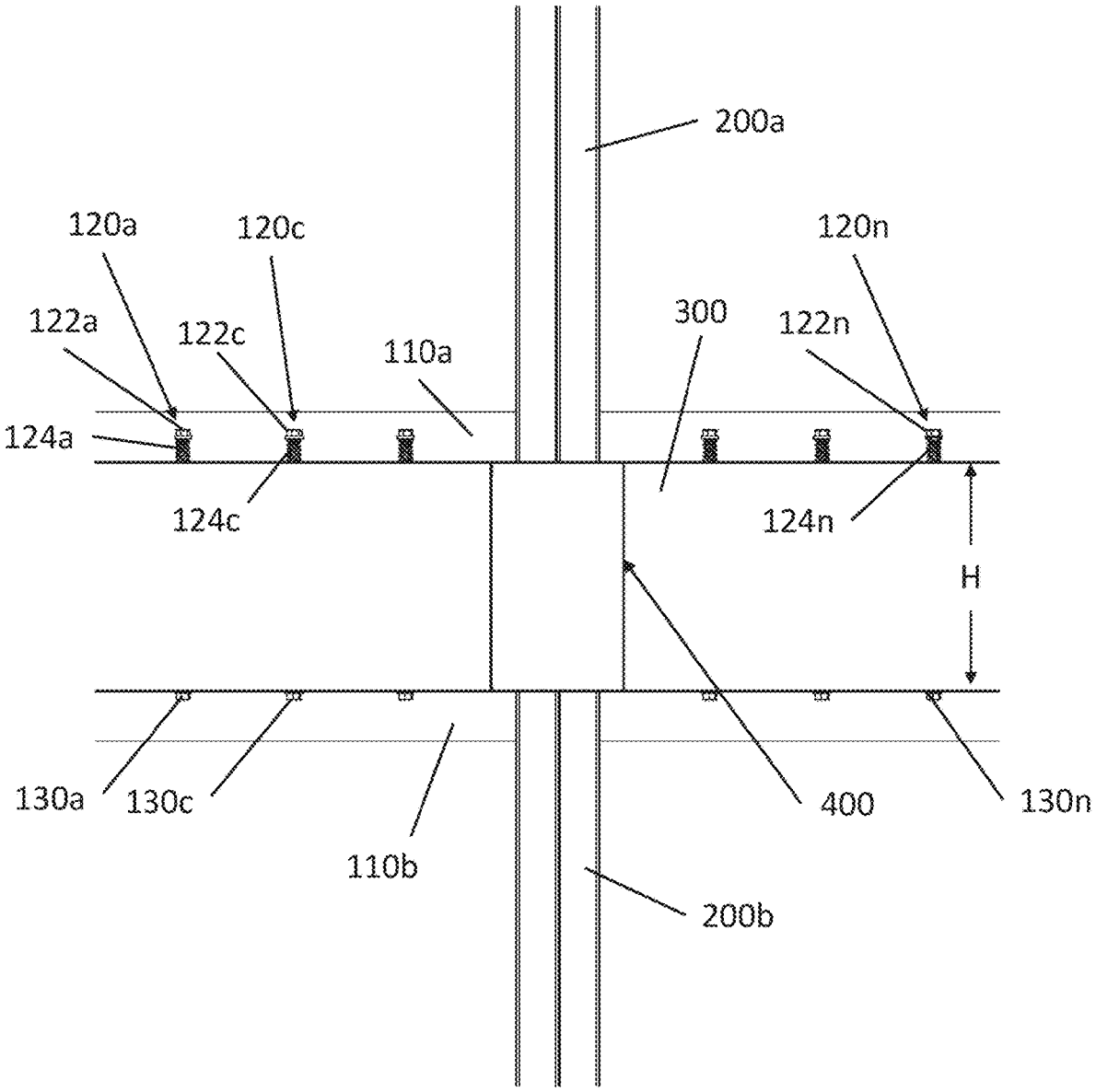
FIG. 6 shows cross-section 6-6 from FIG. 1.

FIG. 6 shows cross-section 6-6 from FIG. 1. The first track 110*a* and the second track 110*b* are continuous. A plurality of spring assemblies 120*a-n* and second fasteners 130*a-n* connect the tracks 110*a*, 110*b* to the CLT panel 300. The tracks 110*a*, 110*b* may be prepunched or predrilled at the location of the spring assemblies 120*a-n* and fasteners 130*a-n* for quick and efficient connection of the tracks 110*a*, 110*b* to the CLT panel 300. The quantity and spacing of the spring assemblies 120*a-n* and fasteners 130*a-n* depends on loads applied to the structure and engineering codes and specifications.

Figure 7:
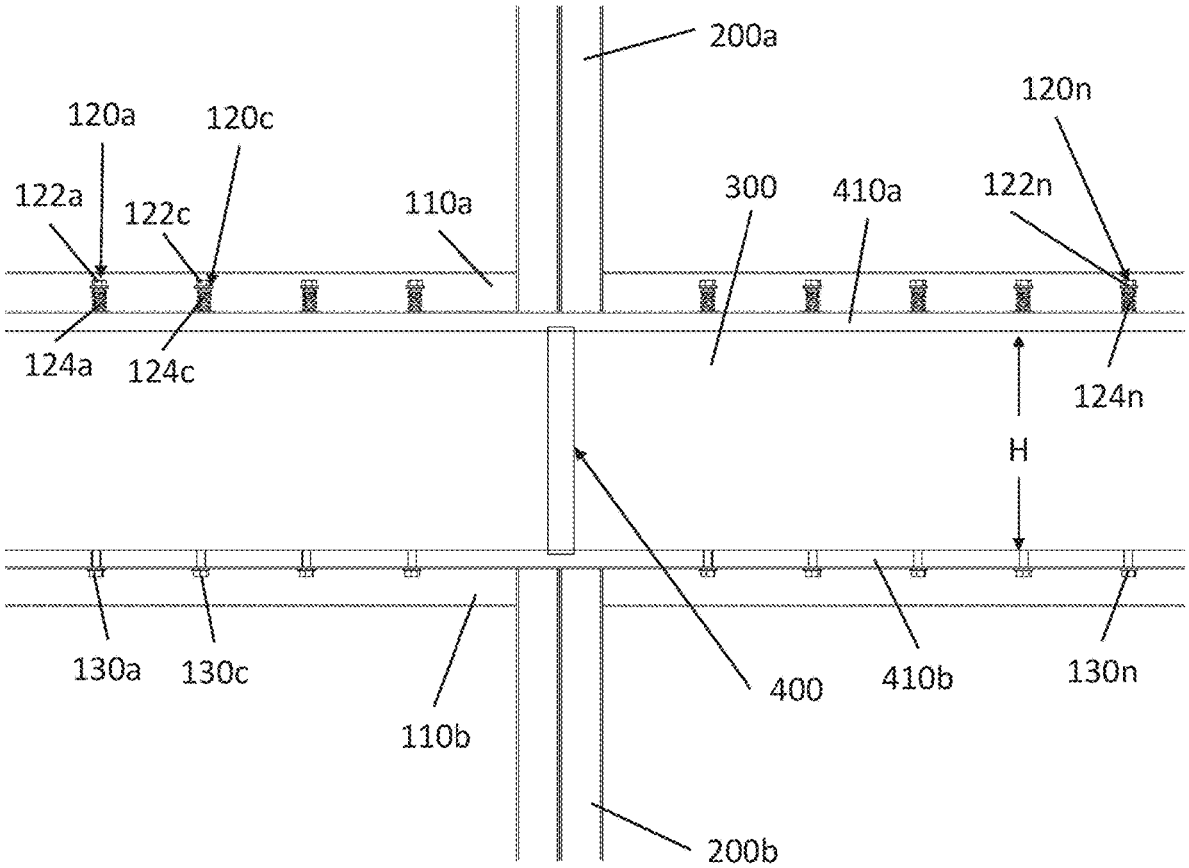
FIG. 7 shows cross-section 7-7 from FIG. 2.

FIG. 7 shows cross-section 7-7 from FIG. 2. The first track 110*a* and the second track 110*b* are continuous. The first steel plate 410*a* and second steel plate 410*b* are also continuous along the length of the CLT panel 300. A plurality of spring assemblies 120*a-n* and second fasteners 130*a-n* connect the tracks 110*a*, 110*b* to the CLT panel 300. The spring assemblies 120*a-n* also extend through the first steel plate 410*a*. Fasteners 130*a-n* connect the second track 110*b* and second steel plate 410*b* to the CLT panel 300. The tracks 110*a*, 110*b* may be prepunched or predrilled at the location of the spring assemblies 120*a-n* and fasteners 130*a-n* for quick and efficient connection of the tracks 110*a*, 110*b* to the CLT panel 300. The steel plates 410*a*, 410*b* may also be prepunched or predrilled at the location of the spring assemblies 120*a-n* and fasteners 130*a-n* for quick and efficient connection of the steel plates 410*a*, 410*b* to the CLT panel 300. The quantity and spacing of the spring assemblies 120*a-n* and fasteners 130*a-n* depends on loads applied to the structure and engineering codes and specifications.

Figure 8:
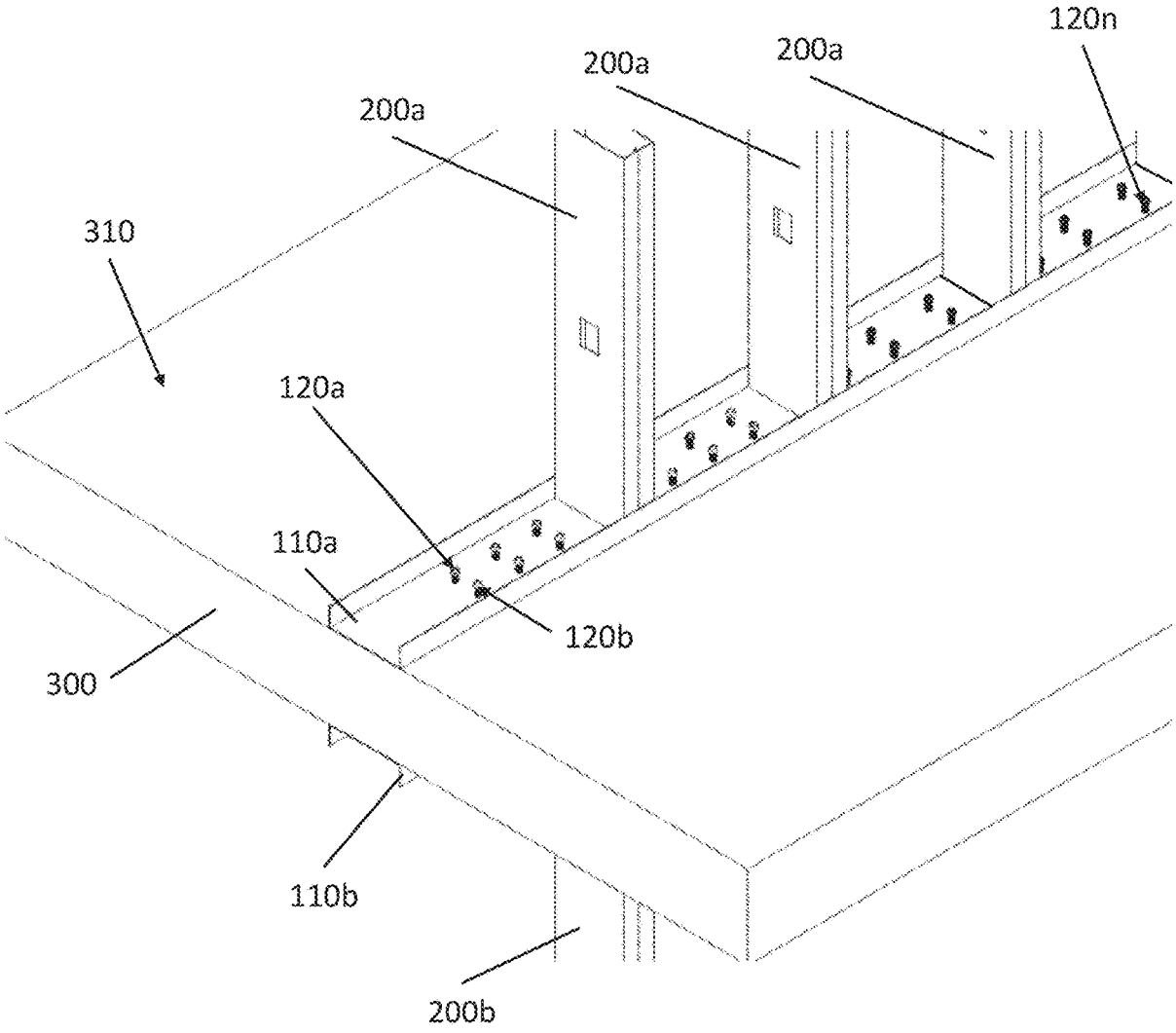
FIG. 8 shows an isometric view of a CLT and CFS system.

FIG. 8 shows an isometric view of a CLT and CFS system 100. The CLT and CFS system 100 includes at least one CFS stud 200*a*, 200*b*. The CFS studs 200*a*, 200*b* may be part of a load bearing CFS panelized wall. The exterior walls may be non-bearing and panelized. The CLT and CFS system 100 also includes at least one CLT floor panel 300. The CLT floor panel 300 may span between 12-20 feet. The CLT floor panel 300 may span greater than 20 feet. The tracks 110*a*, 110*b* may run the length of the CLT floor panel 300. The CFS studs 200*a*, 200*b* are connected to the CLT floor panel 300 via the tracks 110*a*, 110*b*. The number and spacing of the CFS studs 200*a*, 200*b* depend on the loads and engineering codes and specifications. A plurality of spring assemblies 120*a-n* connect a track 110*a* to a first or top side 310 of the CLT floor panel 300 between CFS studs 200*a*.

Figure 9:
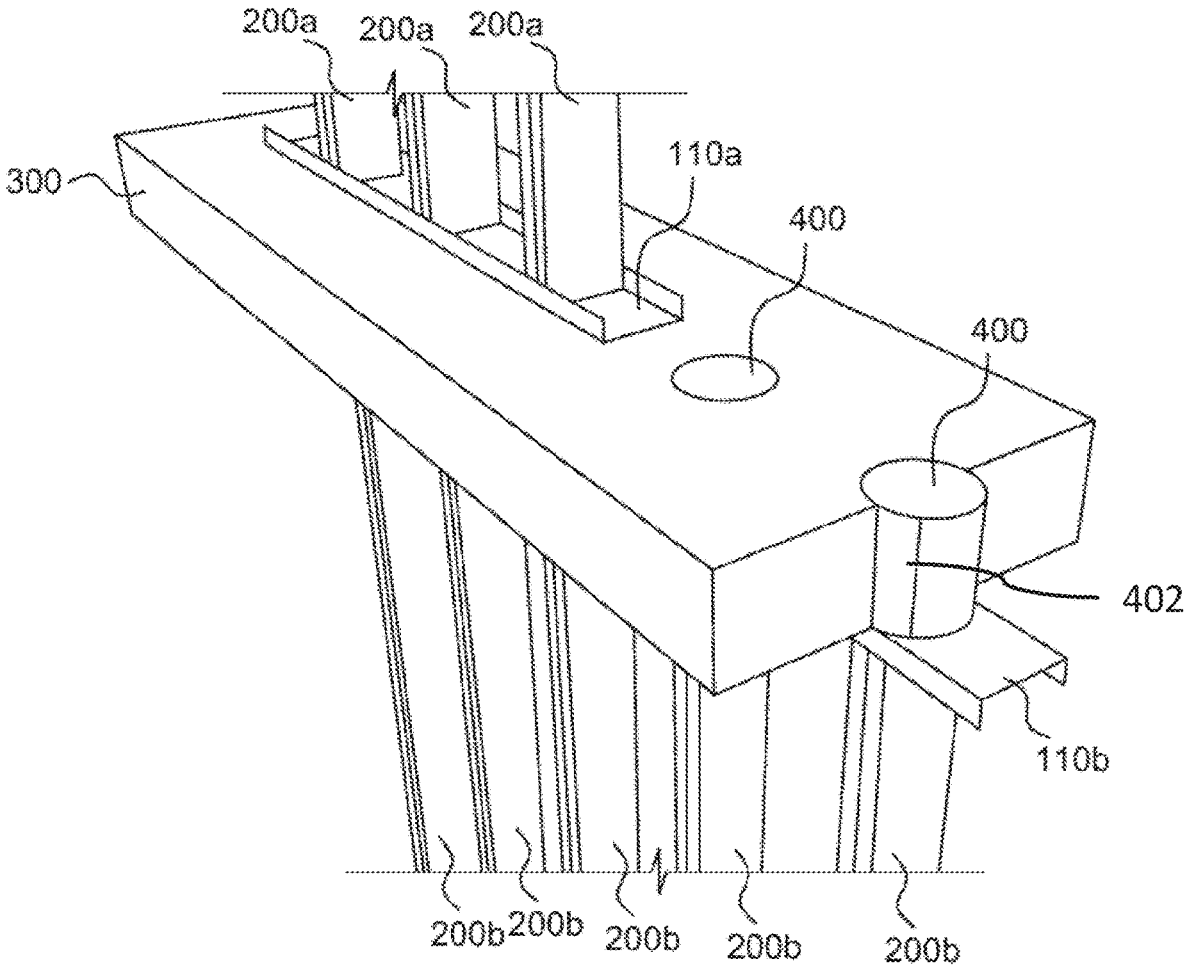
FIG. 9 shows an isometric view of a cross section of a CLT and CFS system.
Figure 10:
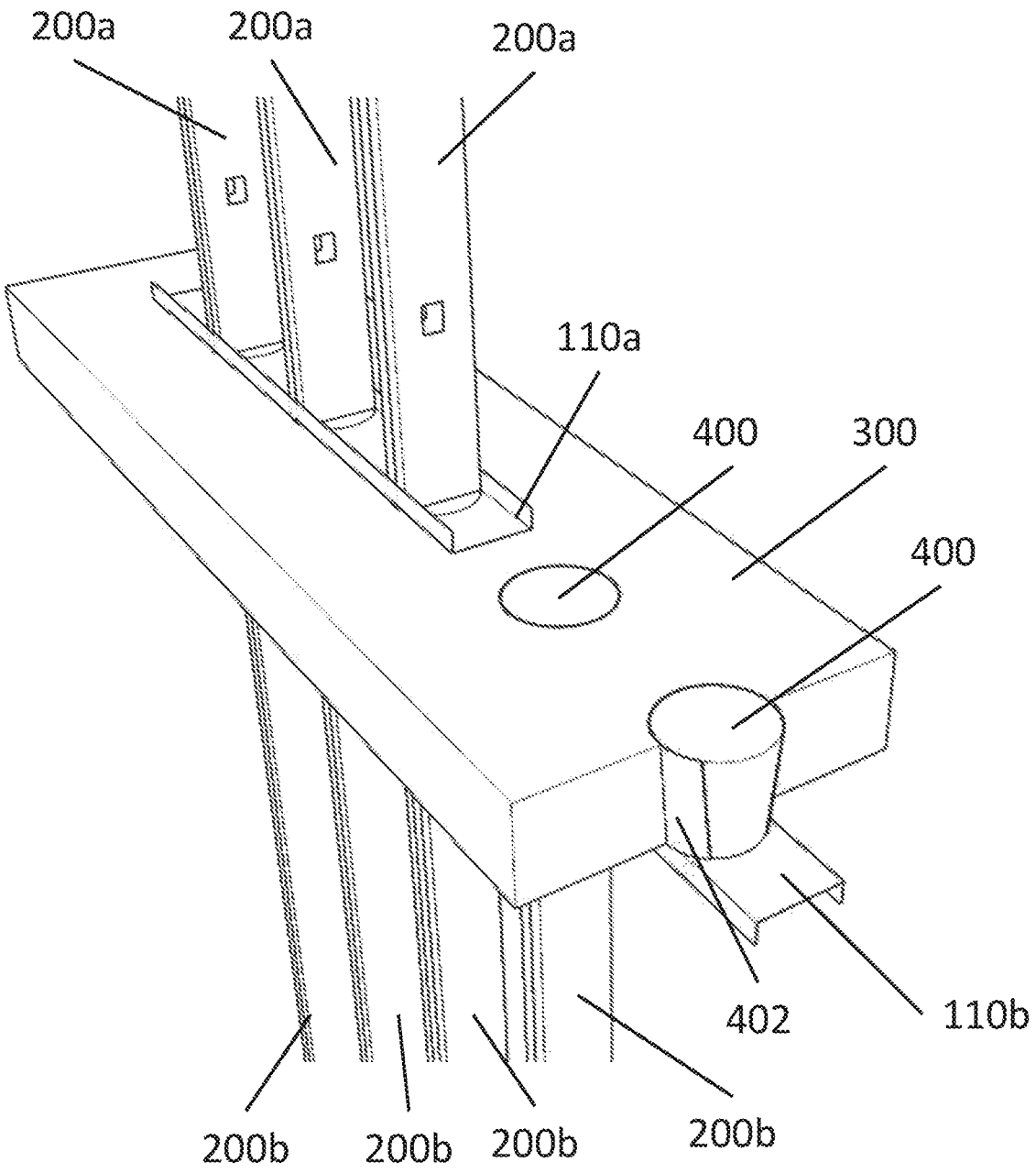
FIG. 10 shows an alternative embodiment of FIG. 9.

FIG. 9 shows a cross-section of an isometric view of a CLT and CFS system 100. The CLT and CFS system 100 includes spacers 400 within the CLT floor panel 300 between corresponding CFS studs 200*a*, 200*b*. The spacer 400 transfers the load from the CFS load bearing stud 200*a* so that the CLT panel 300 is not crushed. The height of the spacer 400 matches the approximate height Hof the CLT panel 300 prior to shrinkage. Although FIG. 6 shows a precast concrete spacer 400, the spacer 400 may be steel or wooden. FIG. 10 shows an alternative embodiment of FIG. 9. FIG. 10 shows a spacer 400 that has a cone shape with the top end wider than the bottom end.

Figure 11:
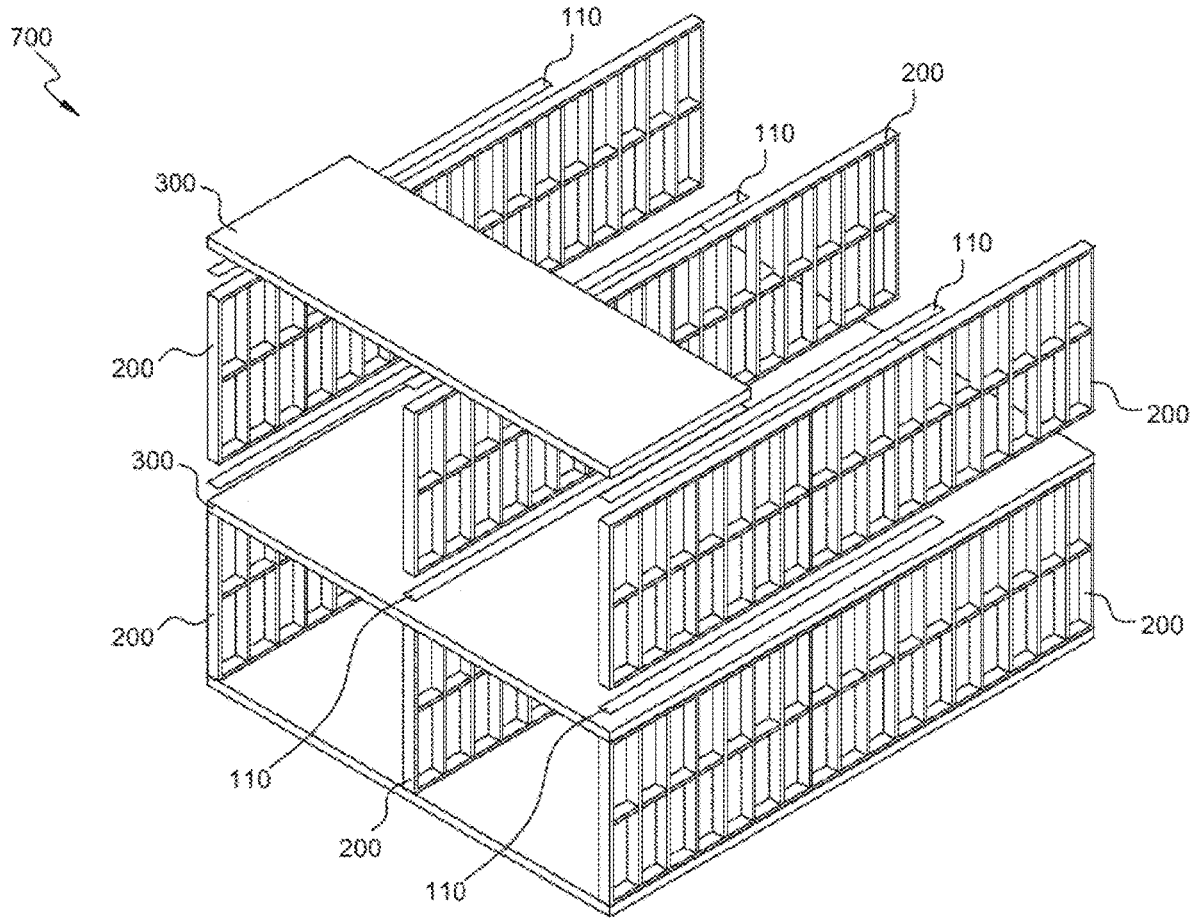
FIG. 11 shows an isometric view of a building comprised of a plurality of CLT and CFS connectors and systems.

FIG. 11 shows an isometric view of a structure 700 utilizing the CLT and CFS system. A plurality of CLT and CFS systems 100 may be utilized to build a structure 700 such as the framework for a building. The structure 700 may be a multistory building. The structure 700 may be a 7-12 story building. Because the structure 700 is comprised of CLT and CFS, the structures 700 are lighter than concrete and steel structures. There is no need to re-shore under active floors. The CLT panels 300 can be prefabricated with the tracks 110 fastened to the CLT panels 300 off-site. The spacers 400 may also be inserted into the CLT panels 300 off-site. On-site, the CLT panels 300 and tracks 110 may be quickly and efficiently connected to the CFS studs. The off-site CLT fabrication and single set installation leads to critical time and labor savings.

Figure 12:
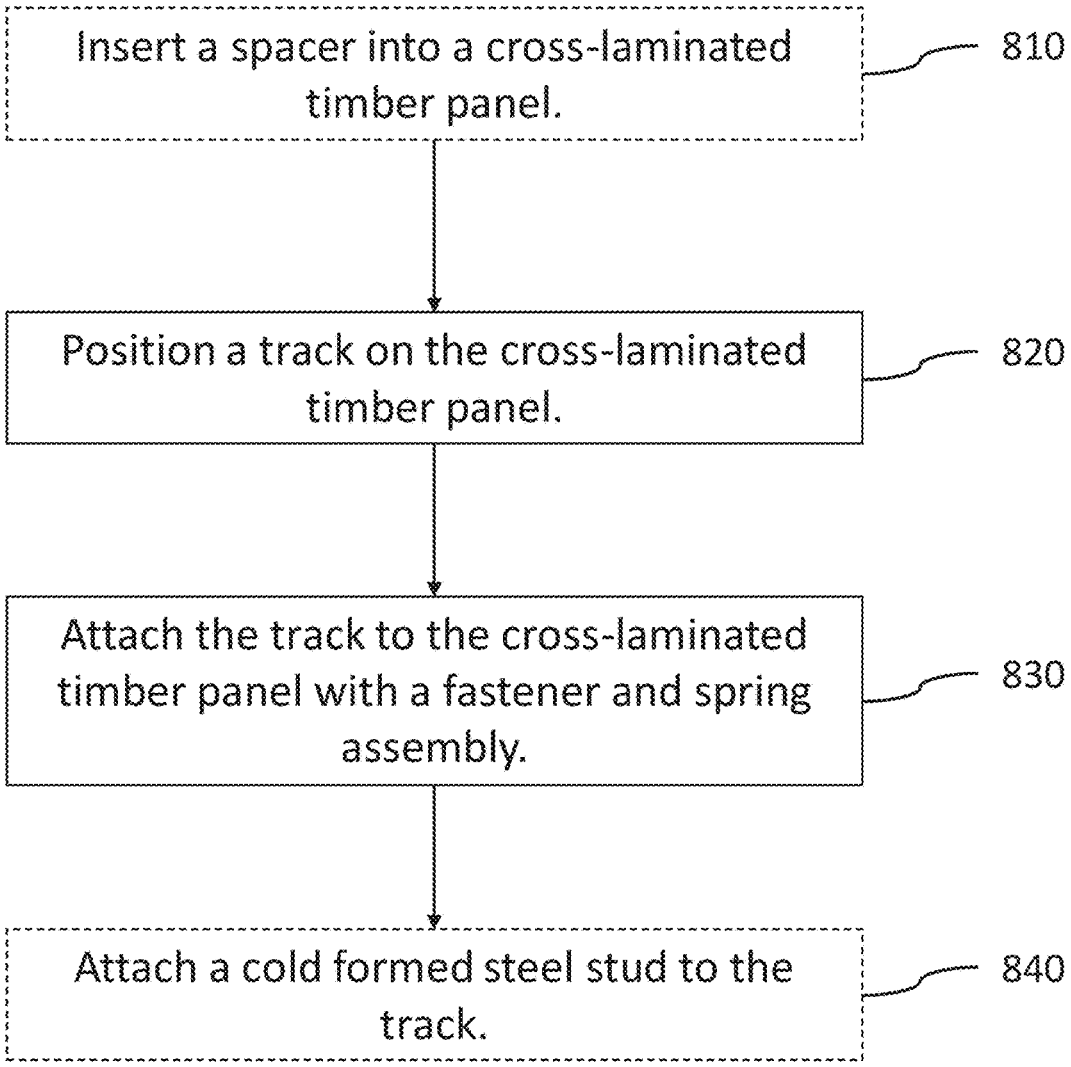
FIG. 12 is a flow chart of a method of installing a CLT and CFS connector.

FIG. 12 is a flow chart of a method of installing a CLT and CFS connector 800. The CLT and CFS connector installed in the method 800 includes the same embodiments and details previously described. In step 810, the method 800 may include inserting a spacer into a CLT panel. The method of installing a CLT and CFS connector 800 includes the step 820 of positioning a track on a cross-laminated timber panel. The track is configured to connect to at least one CFS stud. The track may be positioned where a plurality of CFS studs of a panelized wall are to be connected to the CLT panel. The spacer may be connected to the track or plate. If the spacer is connected to a plate, the plate is connected to the track. The CLT panel may include predrilled holes or openings where the spacer is inserted. The spacers are located where the CFS studs are configured to connect to the track. In step 830, the track is attached to the CLT panel with a plurality of spring assemblies. The spring assembly includes a fastener and a spring. The fastener extends through the spring into the CLT panel. The fastener may be inserted until the spring is partially compressed. For example, the fastener may be inserted into the CLT panel until the spring is compressed 0.25 inches. In step 840, a CFS stud may be connected to the track. The CFS stud may be connected to the track via fasteners, welding, or threads. The CFS stud may bear on the spacer. A plurality of CFS studs may be connected to the track. The method 800 may include the steps 810-840 in any order.

Figure 13:
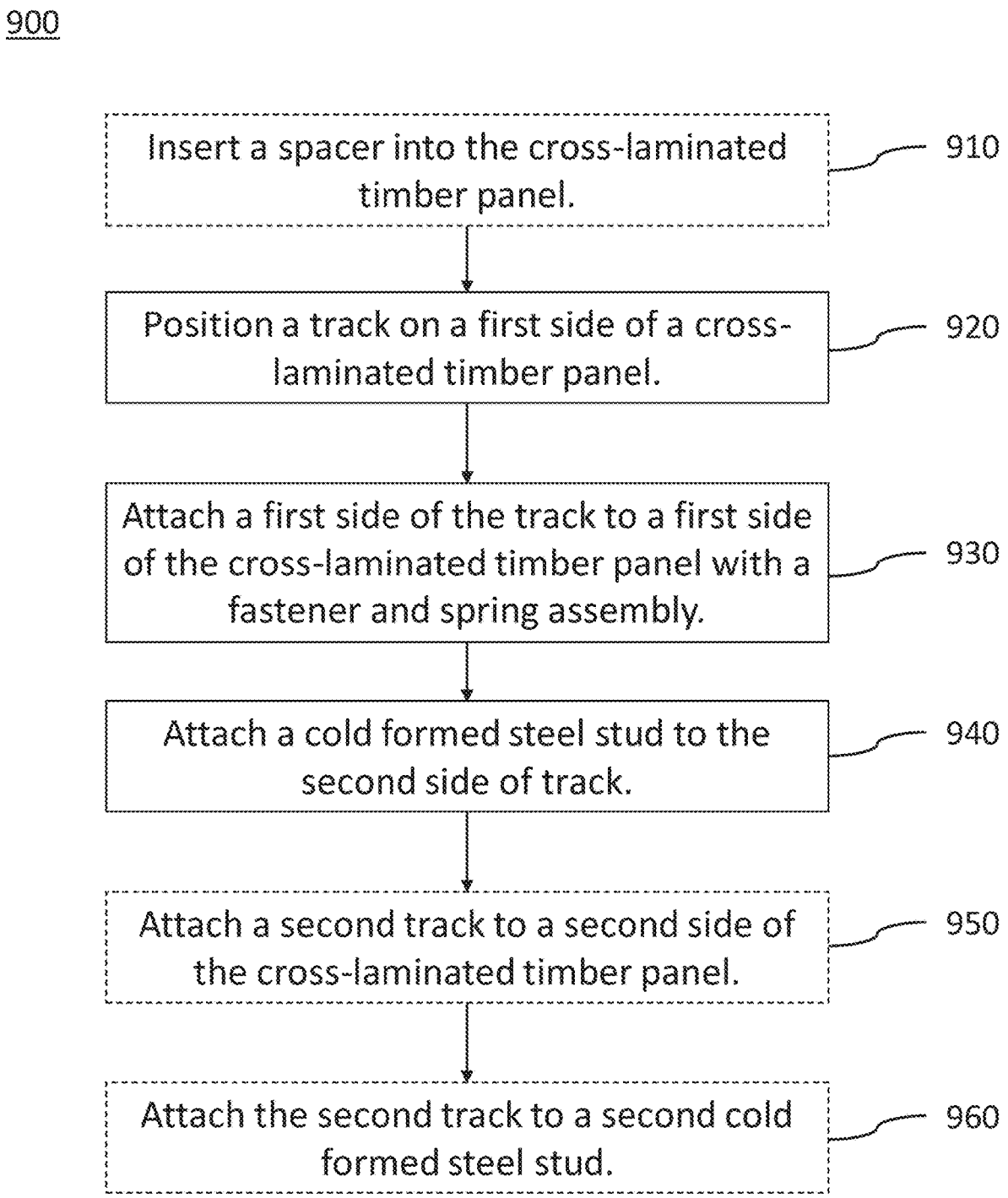
FIG. 13 is a flow chart of a method of installing a CLT and CFS system.

FIG. 13 is a flow chart of a method of installing a CLT and CFS system 900. The CLT and CFS system include the same details and embodiments of the CLT and CFS system previously discussed. In step 910, the method 900 may include inserting a spacer into the CLT panel. The method 900 includes the step 920 of positioning a track on a first side of a CLT panel. The spacer may be connected to the track or plate. If the spacer is connected to a plate, the plate is connected to the track. The CLT panel may include predrilled holes or openings where the spacer is inserted. The spacers are located where the CFS studs are configured to connect to the track. In step 930, a first side of the track is attached to the first side of the CLT panel with a plurality of spring assemblies. A spring assembly includes a fastener and a spring. The fastener extends through the spring into the CLT panel. The fastener is inserted until the spring is partially compressed. For example, the fastener may be inserted into the CLT panel until the spring is compressed 0.25 inch. In step 940, a CFS stud is attached to a second side of the track. The CFS stud may be attached to the track via fasteners, welding, or threads. The CFS stud may bear on the spacer in the CLT panel beneath it. In step 950, a second track may be attached to a second side of the CLT panel. In step 960, the second track may be attached to a second CFS stud. The method 900 may include the steps 910-940 in any order.

Having thus described in detail a preferred selection of embodiments of the present invention, it is to be appreciated and will be apparent to those skilled in the art that many physical changes could be made to the CLT and CFS connector, CLT and CFS system, method of installing a CLT and CFS connector, and method of installing a CLT and CFS system without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. A cross-laminated timber (CLT) floor panel and cold formed steel (CFS) stud connector comprising:

a track, configured to connect to at least one CFS stud, directly seated on at least one load bearing member having a fixed height and positioned above a CLT floor panel that is horizontally adjacent to the at least one load bearing member, the CLT floor panel having a height that varies between the fixed height and a height that is less than the fixed height according to environmental conditions;

a spring assembly comprising:

a fastener having a head, and a shaft that passes through the track to connect to the CLT floor panel; and a spring that receives the shaft and compresses a first amount between the head and the track when the shaft is connected to the CLT floor panel and thereafter compresses a second amount different than the first amount when the height of the CLT floor panel varies.

2. The CLT floor panel and CFS stud connector of claim 1 wherein the track is made from cold formed steel.

3. The CLT floor panel and CFS stud connector of claim 1 wherein the track is U-shaped.

4. The CLT floor panel and CFS stud connector of claim 1 wherein the at least one load bearing member is configured to nest within the CLT floor panel.

5. The CLT floor panel and CFS stud connector of claim 4 wherein the at least one load bearing member is made from steel.

6. The CLT floor panel and CFS stud connector of claim 4 wherein the at least one load bearing member is made from precast concrete.

7. A cross-laminated timber (CLT) floor panel and cold formed steel (CFS) stud connector system comprising:

a first track configured to connect to at least a first CFS stud, directly seated on at least one load bearing member having a fixed height and positioned above a top surface of a CLT floor panel having a height that varies between the fixed height and a height that is less than the fixed height according to environmental conditions;

a second track configured to connect to at least a second CFS stud;

a spring assembly, comprising;

a fastener having a head, and a shaft that passes through the first track to connect the first track to the top surface of the CLT floor panel; and a spring that receives the shaft and compresses a first amount between the head and the first track when the shaft is connected to the top surface of the CLT floor panel and thereafter compresses a second amount different than the first amount when the height of the CLT floor panel varies; and a second fastener configured to connect the second track to bottom surface of the CLT floor panel.

8. The CLT floor panel and CFS stud connector of claim 7 wherein the first track and the second track are made from cold formed steel.

9. The CLT floor panel and CFS stud connector of claim 7 wherein the first track and the second track are U-shaped.

10. The CLT floor panel and CFS stud connector of claim 7 further wherein the at least one load bearing member is configured to nest within the CLT floor panel between the first track and the second track.

11. The CLT floor panel and CFS stud connector of claim 10 wherein the at least one load bearing member is made from steel.

12. The CLT floor panel and CFS stud connector of claim 10 wherein the at least one load bearing member is made from precast concrete.

13. The cross-laminated timber and cold formed steel connector of claim 7 further including a first plate configured to connect to the first track at a location of the first CFS stud.

14. A method of installing a cross-laminated timber (CLT) floor panel and a cold formed steel (CFS) stud connector comprising:

positioning a track, configured to connect to at least one CFS stud, directly on at least one load bearing member having a fixed height and above a CLT floor panel that is horizontally adjacent to the at least one load bearing member, the CLT floor panel having a height equal to or less than the fixed height according to environmental conditions at the time of installation; and holding the track adjacent to the CLT floor panel with a fastener having a head and a shaft, by:

passing the shaft of the fastener through a spring positioned between the head of the fastener and the track;

passing the shaft through the track to connect to the CLT floor panel and tightening the connection between the fastener and the CLT floor panel until the spring is compressed between the head and the track.

15. The method for installing the cross-laminated timber (CLT) floor panel and the cold formed steel (CFS) stud connector of claim 14 further comprising attaching the CFS stud to the track.

16. The method for installing the cross-laminated timber (CLT) floor panel and the cold formed steel (CFS) stud connector of claim 15 wherein the CFS stud is attached to the track with at least one second fastener or by welding.

17. The method for installing the cross-laminated timber (CLT) floor panel and the cold formed steel (CFS) stud connector of claim 15 further comprising inserting the at least one load bearing member into the CLT floor panel.

18. The method for installing a cross-laminated timber (CLT) floor panel and the cold formed steel (CFS) stud connector of claim 17 further comprising connecting the at least one load bearing member to the track.

19. The method for installing the cross-laminated timber (CLT) floor panel and the cold formed steel (CFS) stud connector of claim 17 wherein the at least one load bearing member is made from at least one of steel and precast concrete.

20. The method for installing the cross-laminated timber (CLT) floor panel and cold formed steel (CFS) stud connector of claim 17 wherein the at least one load bearing member is installed at a location of the CFS stud.

* * * * *